United States Patent [19]

Ullrich et al.

[11] Patent Number: 4,862,609

[45] Date of Patent: Sep. 5, 1989

[54] IRONING SOLE PLATE WITH COMPOSITE COATING OF MECHANICALLY-RESISTANT COMPOUND

[75] Inventors: Lothar Ullrich, Marktbreit; Gunter Jung, Hanau; Diethard Burger, Geisenheim; Hans-Günther Alschweig, Schwalbach; Hartmut Schönborn, Steinbach; Winfried Heinzel, Meersburg, all of Fed. Rep. of Germany

[73] Assignee: Braun Aktiengesellschaft, Kronberg, Fed. Rep. of Germany

[21] Appl. No.: 945,839

[22] Filed: Dec. 23, 1986

[30] Foreign Application Priority Data

Dec. 24, 1985 [DE] Fed. Rep. of Germany ... 3546099[U]
Feb. 14, 1986 [DE] Fed. Rep. of Germany ..... 8604031

[51] Int. Cl.[4] ..... D06F 75/38

[52] U.S. Cl. ..... 38/93; 428/422; 428/450; 427/34

[58] Field of Search ..... 427/34, 423; 220/457, 220/458; 75/236; 38/93; 428/422, 450

[56] References Cited

U.S. PATENT DOCUMENTS

| | | | |
|---|---|---|---|
| 3,104,482 | 9/1963 | Jepson . | |
| 3,393,086 | 7/1968 | Keating | 428/422 |
| 3,412,492 | 11/1968 | McCormick . | |
| 3,781,522 | 12/1973 | Borom . | |
| 3,781,523 | 12/1973 | Borom . | |
| 3,816,704 | 6/1974 | Borom . | |
| 4,196,340 | 4/1980 | Evans . | |
| 4,206,340 | 6/1980 | Osrow . | |
| 4,409,354 | 10/1983 | Namba et al. | 428/422 X |
| 4,443,574 | 4/1984 | Coq et al. | 428/422 X |
| 4,588,021 | 5/1986 | Bergeron . | |
| 4,665,637 | 5/1987 | Kramer | 38/93 |
| 4,687,707 | 8/1987 | Matsuo et al. | 428/422 X |
| 4,702,933 | 10/1987 | Kramer | 427/34 |
| 4,800,661 | 1/1989 | Yamamoto et al. | 38/93 |

FOREIGN PATENT DOCUMENTS

| | | | |
|---|---|---|---|
| 949727 | 11/1966 | Fed. Rep. of Germany . | |
| 2151858 | 5/1972 | Fed. Rep. of Germany . | |
| 1952846 | 5/1976 | Fed. Rep. of Germany . | |
| 0150799 | 8/1985 | Japan | 38/93 |
| 956740 | 4/1964 | United Kingdom . | |

OTHER PUBLICATIONS

Determination of Surface Roughness Values, DIN 4768, Deutsches Institut für Normung, 8/1974, Berlin.

*Primary Examiner*—Andrew M. Falik

[57] ABSTRACT

A sole plate (1) for an ironing device, comprising a base body (12) of high thermal conductivity which is preferably an alumimum casting and has on its ironing side (27) a porous coating of a mechanically resistant compound (20), preferably metallic or ceramic materials. The mechanically resistant layer (20) of metallic or ceramic materials is coated with an organic bonding agent (26) having partcularly good sliding, antiadhesive and sealing properties.

12 Claims, 2 Drawing Sheets

IRONING SOLE PLATE WITH COMPOSITE COATING OF MECHANICALLY-RESISTANT COMPOUND

BACKGROUND OF THE INVENTION

This invention relates to a sole plate for an ironing device which is made of a metal of high thermal conductivity, preferably aluminum, and has on its ironing side a coating of a mechanically resistant compound, preferably metallic or ceramic materials.

A sole plate of the type referred to above is described in prior U.S. patent application Ser. No. 06/759,406, Pat. No. 4,665,637. In order to reduce the weight of the ironing device making it easier to handle and to improve the thermal conductivity of the sole plate, a sole plate made of aluminum is used. In view of the reduced weight of the aluminum sole plate as compared with conventional materials such as iron or steel, the sliding ability of the sole plate over the article being ironed is improved.

Since aluminum is known to be less strong than iron or steel, ironing over hard objects as, for example, zippers or buttons tends to scratch the fabric contacting surface, causing burrs protruding from the face of the sole plate similar to a metal-cutting operation. When ironing particularly delicate textile fabrics such as silk, these burrs tend to pull threads from the fabric, thereby damaging it. However, such fabrics will be damaged already when such a burr merely roughens the silky lustrousness of the surface.

To avoid these disadvantages, in the patent application initially referred to the surface of the ironing side was coated with a mechanically resistant compound preferably composed of metallic or ceramic materials, applying flame or plasma spraying techniques. The mechanically resistant layer produced by spraying in this prior application has the disadvantage of being porous and of absorbing in particular water, humidity, air and other impurities which may penetrate to the aluminum sole plate. This produces corrosion on the aluminum surface on the ironing side, tending to cause warpage or blistering and even detachment of the mechanically resistant layer. In consequence thereof, the ironing side of the sole plate is damaged, damaging in turn the textile fabric being ironed in addition to requiring increased forces when moving the ironing device over the article being ironed.

In prolonged use, such sole plates known from the prior art are subject to a great deal of contamination by adhering fabric finishing agents, starch and textile particles burning into the surface when the ironing temperature is too high for these textiles. The result is a dull sole surface impairing the sliding ability over the article being ironed. Removing burnt-in finishing agents by cleaning agents is practically impossible. The only way to restore the sliding ability of the sole plate is to grind off the coating and apply a new coating to the sole plate.

From German published patent application DE-A1-1,952,846, it is further known to coat the metallic ironing side with a layer of temperature-resistant plastic material as, for example, PTFE, which resists contamination and has particularly good sliding abilities. Sole plates of this type in which the fabric contacting surfaces ar made of plastic material tend to become scratched easily and have an insufficient thermal stability, particularly when in continuous use or overheated. Particularly the plastic material becomes locally worn down completely by the pressing action. The scratch resistance is materially reduced particularly in sole plates made of aluminum since the hardness of the aluminum base is insufficient. It has been found that ironing over hard objects as, for example, metal zippers or buttons tends to produce deep scores extending into the aluminum surface, causing detachment of the plastic coating whereby the bare metal may become exposed. In the process, aluminum burrs form at the ends of the scratches which, protruding from the sole plate, eventually damage the article being ironed. Plastic burrs will form already when the plastic material has not yet been worn down to the metal surface.

SUMMARY OF THE INVENTION

Accordingly, it is an object of the present invention to provide a sole plate for an ironing device which is highly resistant to scratches while having good sliding abilities, which resists wear, corrosion and the effect of temperature, which is easy to clean and which can be manufactured simply and inexpensively.

According to the present invention, this object is achieved by coating the mechanically resistant layer of ceramic or metallic material with an antiadhesive and sealing organic bonding agent having particularly good sliding abilities. The mechanically resistant layer applied to the metallic ironing side of the sole plate using, for example, a flame or plasma spraying or some other economical deposition technique is interspersed with pores and fine channels inevitable with such techniques. The bonding agent applied will seal the pores and fine channels of the mechanically resistant layer, so that the steam escaping from the still moist article being ironed cannot penetrate the mechanically resistant layer, whereby damage to the sole plate due to corrosion is avoided.

The arrangement of the invention is highly advantageus in particular also with steam irons, since the steam discharged from the steam outlet ports cannot damage the sole plate by corrosion. The sole plate of the invention is also capable of resisting the action of major mechanical forces as they may occur from time to time during the pressing action. The antiadhesive and sealing coating of the mechanically resistant layer makes it nearly impossible for foreign substances to deposit on the ironing surface. However, should the sole plate have become contaminated once by burnt-in particles of fabric or plastic, the surface can be cleaned readily and without major effort by means of a hard sponge, steel wool or even a special cleaning agent, etc., without the surface showing any signs of wear adversely affecting the advantageous properties or visible scratches.

According to the invention, the micrograph of the rough surface texture on the mechanically resistant layer is such that the elevations are of smoothed configuration. By this improvement of the sole plate of the invention, the elevations which exist on the sole plate surface after the mechanically resistant layer has been sprayed on and which are recognizable as peaks under the microscope are truncated. As a result, the surface does not have the effect of a very fine abrasive paper but is capable of sliding with sufficient ease, causing no appreciable wear on the article being ironed. The roughness height is thus reduced. This smoothing operation performed on the surface of the mechanically resistant layer also serves to help the bonding agent to form a sealed protective film on the surface of the mechanically resistant layer more easily and to accomplish a still better adhesion of the bonding agent through the still existing valleys. Practice has shown that a particularly resistant sole plate affording good slidability results if the surface texture of the mechanically resistant layer has a roughness average rating of between five and ten micrometers following the smoothing operation. In conformity with German Standard DIN 4768, roughness average is defined as the mean value of the individual roughness heights of five single sampling lengths measured consecutively.

With a thickness of the mechanically resistant layer of below 100 micrometers, preferably between 40 and 50 micrometers, the effect of heat produces in the mechanically resistant layer only minor mechanical stresses which are taken up by a desired porosity of between 3% and 10% and by the elastic properties of that layer. The stresses are predominantly due to temperature variations in the (aluminum) sole plate. If the mechanically resistant layer was too thick, stress cracks would occur causing the layer to detach itself or to disintegrate into small pieces. This would make the ironing device useless. However, a minimum layer thickness is necessary to accomplish a sufficient bearing strength or resistance to mechanical impacts on the relatively soft surface of the aluminum sole plate.

In an improvement of the invention, these advantages are particularly enhanced by applying such a thin coating of bonding agent to the mechanically resistant layer that the surface texture of the mechanically resistant layer is substantially maintained on the surface of the bond coating. As a result, the ironing surface has a specific desired average roughness. It is to be noted that the application of an excessively thick coating of bonding agent to the mechanically resistant layer, while increasing the sliding ability of the sole plate, will reduce its scratch resistance, since burrs may form easily in the bond coating which is relatively soft as compared with the mechanically resistant layer, the burrs causing raised spots on the surface of the bond coating as initially explained with reference to the prior art. Although the resistivity of these raised burrs is not too high, it is nevertheless sufficient to damage especially delicate textile fabrics.

In another aspect, the surface of the mechanically resistant layer is coated with the bonding agent such that the valleys formed due to the roughness height are filled with the bonding agent while the area determined by the highest abraded tips of the peaks, which area forms the bearing area of the sole plate, is coated with a thin film only. This type of sealing affords the advantage of producing a sole plate with particularly good sliding abilities on account of the still very thin appication of bonding agent to the areas of the mechanically resistant layer forming the bearing area. In spite of the very thin coating, the mechanically resistant layer can be scratched off only with great difficulty, this being prevented by the adhesive forces existing between the bond coating and the mechanically resistant layer. Accordingly, the thicker the bond coating becomes in the area of the bearing surface, the more elastic is its surface and the more prone to removal of bonding agent are these areas. Consequently, in this type of application the bond coating is hard and wear-resistant.

Because the ratio of the coefficients of expansion of the bond coating to the mechanically resistant layer is of the order of 10:1, an increase in temperature will cause the bonding material embedded in the valleys to virtually expand upwardly beyond the bearing area, thus producing a certain self-healing effect in respect of the bond coating should it have become damaged above the peaks, for example, by scratches or scores. This self-healing effect is due to the partial displacement of the amounts of material expanding from the valleys beyond the boundary layer during ironing and their subsequent deposition on the marred spot. In this manner, a durable sealing effect and an excellent sliding property of the sole plate are ensured.

However, the width of the valleys must not be too large because this would result in a relatively large accumulation of bonding material in the valleys, producing a comparatively large protuberance of the bond coating between the individual peaks on the bearing area. This would have the undesired concomitant that indentations in which particles of the article being ironed may deposit are formed above the peaks where the protuberance is smaller than above the valleys.

To accomplish a high wear resistance at concurrent low coefficients of friction, the mean thickness of the bond film is advantageously below ten micrometers, preferably between 0.1 and 2 micrometers. With these dimensional values, coefficients of friction of between 0.12 and 0.20 result for a sole plate at room temperature when ironing on cotton fabric (German Standard DIN 53919). If the sole plate is heated for ironing, the effect of thermal expansion causes the bond coating to expand out of the boundary area, thereby reducing the coefficients of friction.

Suitable bonding agents are, in particular, resinous binders enriched by PTFE or PFA or silicone. These materials have particularly good sliding properties also in combination with resinous binder, are highly temperature-resistant and, by virtue of the roughness height configuration of the invention, have good adhesion to the sole plate substrate. Practice has shown that, as the bonding material is sprayed on, the PTFE, PFA or silicone particles in the resinous binder tend to rise to the surface of the bond coating. From this it results that there are hardly any amounts of PTFE, PFA or silicone left in the lower layers of the bond coating. Consequently, these remaining amounts are abraded from the surface relatively quickly during ironing.

To maintain a uniform distribution of the PTFE, PFA or silicone particles in the resinous binder also after the bonding material is sprayed on, an improvement provides for the addition of a filler, preferably barium sulphate, to the bonding agent. In this improvement, the bond consists of 40% to 50% resinous binder, 5% to 10% filler, the remainder being PTFE or PFA or silicone. The filler acting in a particlelike fashion, thereby causing an increase in friction upon contact with the article being ironed, the amount of filler added must not be too high. Since the adhesive strength of the bonding agent relative to the surface of the mechanically resistant material is determined neither by the amounts of PTFE nor by the filler, but by the resinous binder alone, it is also for this reason that the amount of filler must not be too high. Accordingly, in order to have almost exclusively resinous binder deposit on the surface of the mechanically resistant material for the purpose of promoting adhesion, a slight rising of the amounts of PTFE is even desired, however, only until the surface of the mechanically resistant layer is almost free of amounts of PTFE.

When diluted, the bonding agent creeps particularly readily, thereby sealing the pores and fine channels in the deeper regions of the mechanically resistant layer.

To avoid that the bond coating of the sole plate stains the article being ironed at elevated temperatures, ensuring at the same time a good appearance of the sole plate as used to be the case previously with prior known uncoated sole plates made of cast iron or steel, the invention provides for a colorless and transparent bonding agent. This enables the color of the mechanically resistant layer to shine through.

A preferred dark-gray to black color is obtained by the mechanically resistant layer being composed of a mixture of $Al_2O_3$ and $TiO_2$, with the mixture ratio being of the order of 2:1. Using these compounds in other suitable mixture ratios, any gray scale value can be achieved. A light gray sole plate is produced at a mixture ratio of about 97:3. As a result of the predetermined low roughness of the ironing surface of the sole plate, a dull-bright surface is obtained showing excellent resistance to impurities and good sliding ability. While the mechanical consistence of a colorless bonding agent is more sensitive than, and not as stable as, colored bonding agents, practice has nevertheless shown that the bonding agent of the invention produces excellent results, the absence of coloring pigments eliminating the risk of the article being ironed becoming stained.

Advantageously, a layer of an adhesive vehicle which is preferably composed of an alloy of nickel and aluminum is provided between the surface of the metal of good thermal conductivity and the mechanically resistant layer. The adhesive vehicle layer may be applied so as to cover the entire area or, alternatively, in such a manner that isolated voids are maintained. The vehicle serves to promote the adhesion of the mechanically resistant layer to the sole plate.

The manufacturing process of the sole plate of the invention involves a surface treatment of the mechanically resistant layer prior to the application of the bonding agent. In this process, a mechanical surface treatment has proved to be particularly economical, permitting also the desired roughness height to be maintained accurately. The process may also involve several operations in which the surface of the mechanically resistant layer is treated such that predominantly only the tips of the highest peaks of the surface texture are abraded. With a mechanically resistant layer which is not too hard, that is, at a mixture ratio of the order of 2:1 or less ($Al_2O_3$:$TiO_2$), this operation can be advantageously performed by a brush tool smoothing the surface of the mechanically resistant layer within a minimum of time. Other known smoothing techniques such as grinding are to be applied where the mechanically resistant layer is very hard which, for example, is the case at a mixture ratio of about 97:3 ($Al_2O_3$:$TiO_2$). It is to be understood that grinding methods may also be used on surfaces which are less hard. Where grinding wheels are used for smoothing the surface, these are preferably elastomer-bonded grinding wheels having a Shore hardness of between 60 and 80 and a grit size of 120, 240 or 400.

Following smoothing of the surface of the mechanically resistant layer, another advantageous embodiment of the invention provides for cleaning applying a combined pressure and suction blasting method or an ultrasonic method in aqueous solution, in order to obtain a greasefree surface.

Subsequently, only such an amount of bonding agent is applied that the roughness height one the surface of the bond coating substantially corresponds to the roughness height of the surface of the mechanically resistant layer. According to another aspect of the invention, the amount of bonding agent applied may be chosen such that the valleys are filled with bonding agent and that the bearing area determined by the highest tips of the peaks is coated with a thin film of a thickness of less than 10 micrometers, preferably of between 0.5 and 2 micrometers. The appropriate dosage of bonding agent can be accomplished particularly easily by electrostatic spraying of the bonding agent on the surface of the mechanically resistant layer. Electrostatic spraying permits an extremely fine jet in which the droplets produced, on account of their good creeping ability, are able to penetrate directly into the pores and the fine channels of the mechanically resistant layer, the bonding agent thus coating the surface texture with a nearly homogeneous film. For this purpose, a thinner is added to the highly brushable bonding agent which, for example, consists of PTFE or PFA or silicone and resinous binder. Shortly after the bonding agent is sprayed on, the highly volatile thinner will evaporate, leaving PTFE, PFA or silicone amounts enclosed in the remaining resinous binder.

It is advantageous to cure the sole plate by subjecting the bonding agent to heat treatment by infrared radiation using, for example, a quartz lamp. By contrast with known drying methods as, for example, the hot-air oven drying method, the bond coatng can be cured in a substantially shorter period of time. In view of the shorter curing period of the bonding agent and the fact that the sole plate is not heated in its entirety but merely locally on its surface, an expansion of gases in the cavities (pores, shrinkholes) resulting from the casting of the aluminum sole plate is largely prevented. Applying recirculated air drying methods to a sole plate of the state of the art has revealed that, due to the substantially longer application of heat for curing the bonding agent, gases escape from the sole plate aluminum casting which may cause local warpage of the aluminum sole and/or the bond coating. This disadvantage would also occur in the presence of an additional mechanically resistant layer. An infrared radiation apparatus builds to substantially smaller dimensions as compared with a conventional drying apparatus, thereby affording price advantages in the manufacture of the sole plate of the invention.

BRIEF DESCRIPTION OF THE DRAWING

Two embodiments of a surface layer structure of a sole plate of the invention will be described in more detail in the following with reference to the accompanying drawing in which.

DESCRIPTION OF THE PREFERRED EMBODIMENTS

Figure 1:
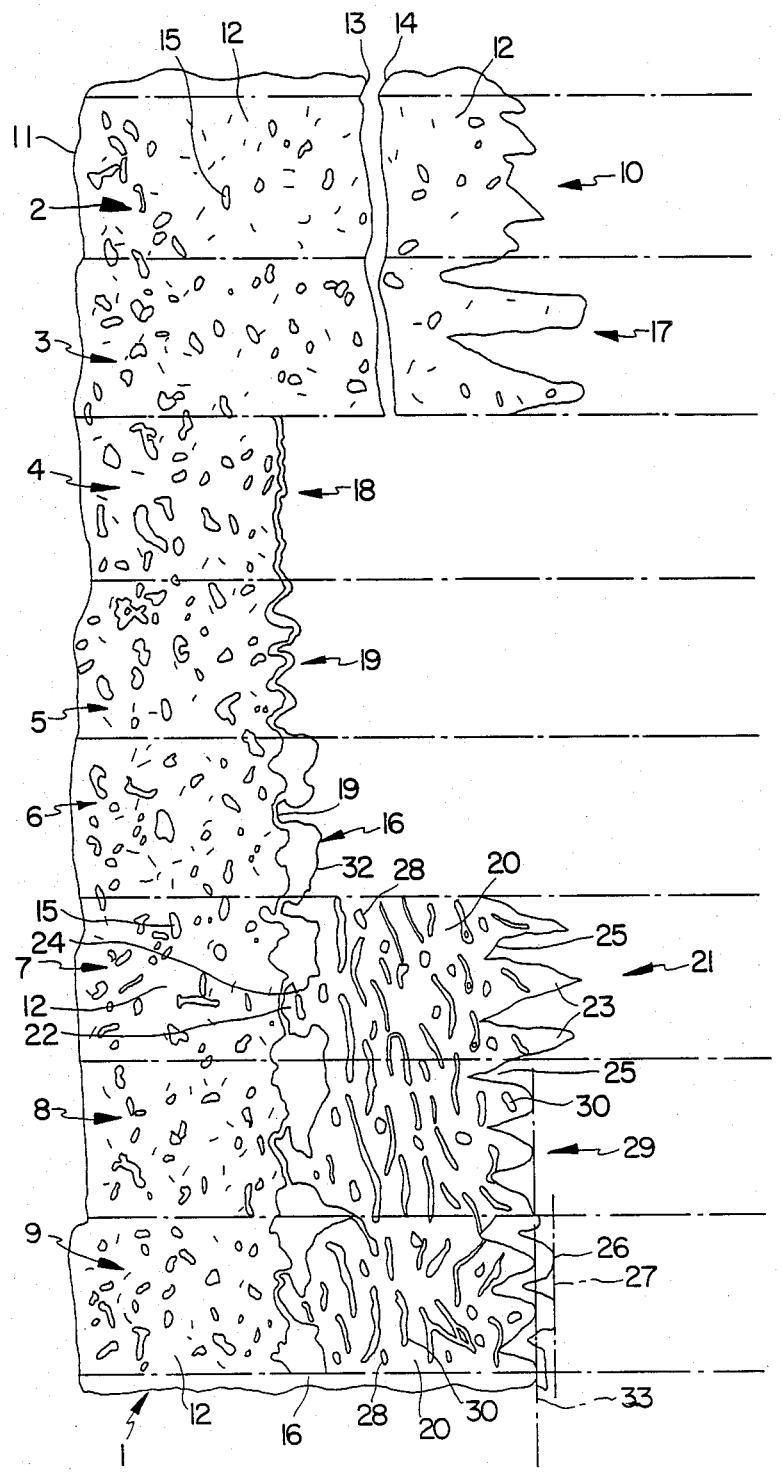
FIG. 1 is a cross sectional view of a first embodiment of a sole plate of the invention.

Referring now to FIG. 1, there is shown a cross sectional view of the surface of the sole plate 1 of an ironing device, illustrating from top to bottom the respective surface texture of respective sections 2 to 9 after each operation. Starting from surface 10, each of the sections 2 to 9 is shown as extending only to a depth of the aluminum base body 12 of the sole plate 1 illustrated by the break line 11, since the sectional views are shown on a greatly enlarged scale.

In section 2, part of the base body 12 is shown as cast. The aluminum base body 12 may be manufactured applying any one of the generally known aluminum casting processes.

The vertical break lines 13, 14 shown in the sections 2 and 3 of the drawing indicate that part of the layer thickness of the base body 12 has been omitted in this area. This was necessary to be able to illustrate in the drawing also the surfaces 10 and 17 of the sections 2 and 3, respectively. In the cross sectional view of the aluminum base body 12, inclusions, shrinkholes or other pores 15 inevitably forming in the casting of aluminum will be recognized.

Following casting of the base body 12, the surface 10 has a roughness average rating of between 10 and 20 micrometers. Subsequently, the surface 10 may be blasted for cleaning and deburring purposes. The result is approximately the texture of the surface 17 shown in section 3.

Subsequent to this operation, the surface 17 or, if the blasting operation is omitted, the surface 10 is ground off to such a depth that the resulting surface 18 has a roughness average rating of between 0.6 and 4 micrometers, approximately, particularly of between 1 and 2 micrometers. The grinding operation is necessary because the base body 12 may deform following casting as a result of the drop in temperature, whereby its surface 10 may bulge. Following grinding, oxides and other impurities are removed from the surface 18 by corundum blasting or a similar surface treatment method, resulting in the surface 19 shown in section 5.

The surface 19 is then further treated by applying to it an adhesive vehicle 16 such as nickel aluminum (NiAl) by flame or plasma spraying. In this alloy, the amount of aluminum (Al) is preferably between 29% and 33%. In addition to mechanically bonding the mechanically resistant layer 20 to the base body 10, the adhesive vehicle layer also serves the purpose of establishing a diffusion bonding between the purely ionic bond of the mechanically resistant layer and the purely metallic bond of the aluminum base body 12. The NiAl particles form areas 32 producing on the surface 19 a sealed (FIG. 2) or a not sealed (FIG. 1) adhesive vehicle layer 16, depending on the amount of material applied. A sealed layer of adhesive vehicle 16 preferably has a roughness average rating of between 10 and 20 micrometers at a mean thickness of about 12 micrometers.

In the next operation, a mechanically resistant layer 20 of ceramic or metallic materials is applied to the areas 32 and to the partially still uncoated (FIG. 1) or coated (FIG. 2) surface 19 by flame or plasma spraying. The surface 21 thus obtained has a roughness average rating of between 10 and 20 micrometers. The thickness of the mechanically resistant layer 20 is below 100 micrometers, preferably between about 40 and 50 micrometers. With an adhesive vehicle layer 16 according to FIG. 1, the material of the mechanically resistant layer 20 fills the voids 22 formed between the areas 32, coating also the surface 19. With an adhesive vehicle layer 16 according to both FIG. 1 and FIG. 2, the material of the mechanically resistant layer 20 spreads behind the projections 24 formed intermediate the individual adhesive vehicle areas 32 prior to the spraying of the mechanically resistant layer 20, so that a particularly intimate and tight bond is established between the mechanically resistant layer 20 and the base body 12. On an increase in temperature of the sole plate 1, stresses occurring due to the differences in the coefficients of expansion of the mechanically resistant layer 20 and the aluminum base body 12 are compensated for by the porisity (pores 28 and channels 30) of the mechanically resistant layer 20. This porosity is between 3% and 7%, preferably in the range of 5%. However, the adhesive vehicle layer 16 also contributes to the compensation of stresses.

Since the surface 21 of the mechanically resistant layer 20 has particularly sharp-edged tips of the peaks 23 (FIG. 1) resulting from the production process, these are abraded down to a predetermined height in a subsequent mechanical surface treatment process as, for example, polishing, brushing or grinding. The surface 29 thereby obtained is shown in section 8. The area defined by the highest abraded tips of the peaks 23 forms the bearing area 33 of the sole plate 1. In this surface treatment operation, the average roughness rating is reduced from between 10 and 20 micrometers to between 5 and 10 micrometers, approximately; this operation has no or only a minor effect on the deeper regions of the valleys 25.

The last but one operation involves spraying of an organic bonding agent 26, as shown in section 9. The organic bonding agent is a combination of PTFE or PFA or silicone with a resinous binder, a filler effecting a uniform distribution of the PTFE, PFA or silicone particles in the resinous binder, and a thinner. The bonding agent can be sprayed on to form such a thin coating 26 (FIG. 1) that the resulting roughness average value of the bond coating 26 remains almost unchanged relative to the roughness average value of the mechanically resistant layer 20 indicated in section 8. Accordingly, in this embodiment the bonding agent 26 is applied to an approximately even thickness both in the valleys 25 and on the peaks 23.

Figure 2:
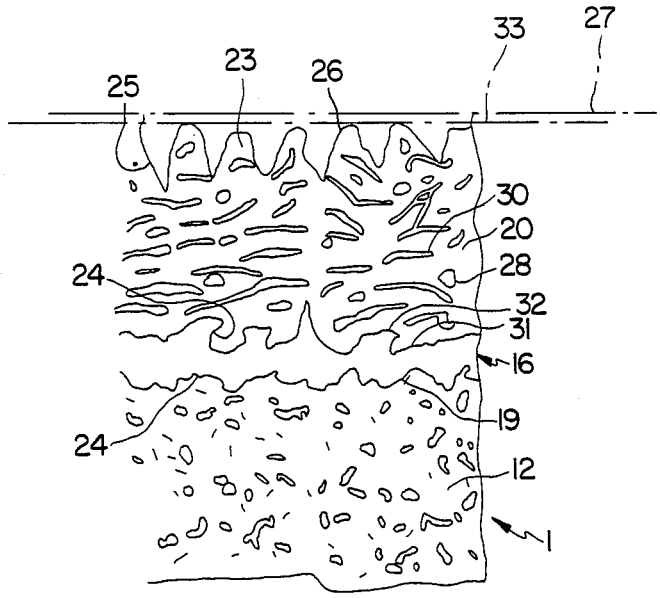
FIG. 2 is a detail view of section 9 of FIG. 1, illustrating both the adhesive vehicle layer and the bond coating in accordance with another embodiment of the invention.

The bond coating 26 illustrated in FIG. 2 is obtained by applying such an amount of bonding agent 26 that the valleys 25 are filled with bonding agent 26 and that the area determined by the highest abraded tips of the peaks 23, which area forms the bearing area 33 of the sole plate 1, is coated with only a thin film.

The mechanically resistant layer 20 incorporates a large number of inclusions or pores 28 and fine channels 30 which would allow liquid matter and impurities to penetrate unless prevented by the bond coating 26. The channels 30 are formed as a result of the pancake structure of the mechanically resistant layer 20 produced by the flame or plasma spraying process. Section 9 does not, however, show the embedding of the bonding agent 26 in the deeper subsurface regions of the mechanically resistant layer 20.

In the final operation, the ironing surface 27 of the sole plate 1 is exposed to infrared radiation to enable the bonding agent 26 to dry and cure. Infrared radiation heats the surface 27 of the sole plate 1 rapidly, curing the bond coating 25 within a minimum of time without the risk of the heat causing an expansion of the aluminum base body 12 which would adversely affect the sole plate 1.

Figure 3:
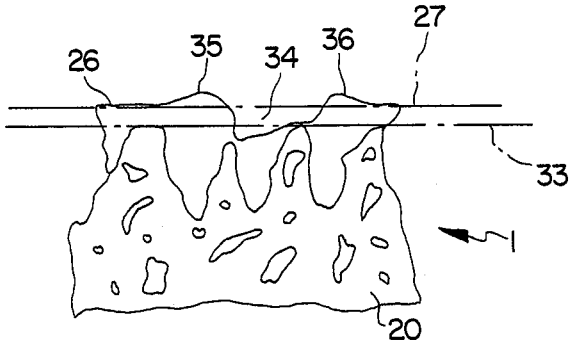
FIG. 3 is a detail view of FIG. 2 in the area of the bond coating showing a defective spot.

In FIG. 3, the surface 27 of a bond coating 26 configured according to FIG. 2 shows a scratch, a score or a similar mar 34 which has caused the bond coating 26 to be worn down to the mechanically resistant layer 20. As the sole plate 1 is heated, the mar 34 will heal itself, since the increase in temperature will cause the bonding material 26 embedded in the two valleys on either side of the mar 34 to virtually expand upwardly beyond the contour of the surface 27 (see bulges 35 and 36). During ironing, the effect of friction thereby produced will displace this material, moving it towards the mar 34, whereby the bond coating 26 will be re-established in the place of the mar 34.

We claim:

1. A sole plate for an ironing device which has a base portion of a metal of high thermal conductivity, a coating of a mechanically resistant compound on the ironing side of said base portion to provide a texture surface that has peaks and valleys, the surface texture of the mechanically resistant layer having a roughness average rating of between five and ten micrometers, and an antiadhesive and sealing organic bonding agent coating the surface of said mechanically resistant layer such that the valleys in said layer are filled with said bonding agent and the regions at the highest peaks of said mechanically resistant layer are coated with only a thin film of said bonding agent, said bonding agent having good sliding abilities and the mean thickness of said thin film being below ten micrometers, preferably between 0.01 and 2 micrometers.

2. A sole plate for an ironing device which has a base portion of a metal of high thermal conductivity, a coating of a mechanically resistant compound on the ironing side of said base portion to provide a surface texture that has peaks and valleys and a roughness average rating of between five and ten micrometers, and an antiadhesive and sealing organic bonding agent coating the surface of said mechanically resistant layer with only a thin film such that the valleys and the regions at the highest peaks of said mechanically resistant layer are coated with only a thin film of said bonding agent, so that the roughness average rating of said mechanically resistant layer is substantially maintained at the surface of said bonding agent, said bonding agent having good sliding abilities and the mean thickness of said thin film being below ten micrometers, preferably between 0.01 and 2 micrometers.

3. A sole plate as claimed in claim 2 wherein the thickness of the mechanically resisant layer (20) is below 100 micrometers, preferably however in the range of 40 to 50 micrometers.

4. A sole plate as claimed in claim 2 or 1 characterized in that the bonding agent (26) consists of a resinous binder enriched by PTFE (polytetrafluoroethylene) or PFA (perfluoroalkyloxide polymers) or silicone.

5. A sole plate as claimed in claim 4 and further including a filler, preferably barium sulphate, in the bonding agent (26).

6. A sole plate as claimed in claim 5 wherein said bonding agent consists of the following weight percentage: 40% to 50% resinous binder, 5% to 10% filler, the remainder being PTFE or PFA or silicone.

7. A sole plate as claimed in claim 2 or 1 wherein said bonding agent is colorless and transparent.

8. A sole plate as claimed in claim 2 or 1 wherein said mechanically resistant layer is composed of a mixture of alumina ($Al_2O_3$) and titania ($TiO_2$).

9. A sole plate as claimed in claim 8 wherein the mixture ratio of $Al_2O_3$ to $TiO_2$ is 2:1, approximately.

10. A sole plate as claimed in claim 8 wherein mixture ratio of $Al_2O_3$ to $TiO_2$ is 97:3, approximately.

11. A sole plate as claimed in claim 2 or 1 and further including a layer of an adhesive vehicle between the surface of the metal of good thermal conductivity and the mechanically resistant layer.

12. A sole plate as claimed in claim 11 wherein said adhesive vehicle layer consists of an alloy of nickel and aluminum (NiAl).

* * * * *

UNITED STATES PATENT AND TRADEMARK OFFICE

CERTIFICATE OF CORRECTION

PATENT NO. : 4,862,609

DATED : September 5, 1989

INVENTOR(S) : Lothar Ullrich, et al.

It is certified that error appears in the above-identified patent and that said Letters Patent is hereby corrected as shown below:

In the Title, after "IRONING" insert --DEVICE--.

Col. 1, in the tilte, after "IRONING" insert --DEVICE--.

Col. 1, line 65, "ar" should be --are--.

Col. 3, lines 53-54, "appica-tion" should be --application--.

Col. 4, line 54, "particlelike" should be --particle-like--.

Col. 5, line 68, "one" should be "on".

Col. 6, line 29, "coatng" should be --coating--.

Col. 8, line 61, "25" should be --26--.

UNITED STATES PATENT AND TRADEMARK OFFICE

CERTIFICATE OF CORRECTION

PATENT NO. : 4,862,609

DATED : September 5, 1989

INVENTOR(S) : Lothar Ullrich, et al.

It is certified that error appears in the above-identified patent and that said Letters Patent is hereby corrected as shown below:

Figs. 1-3 should appear as set out below:

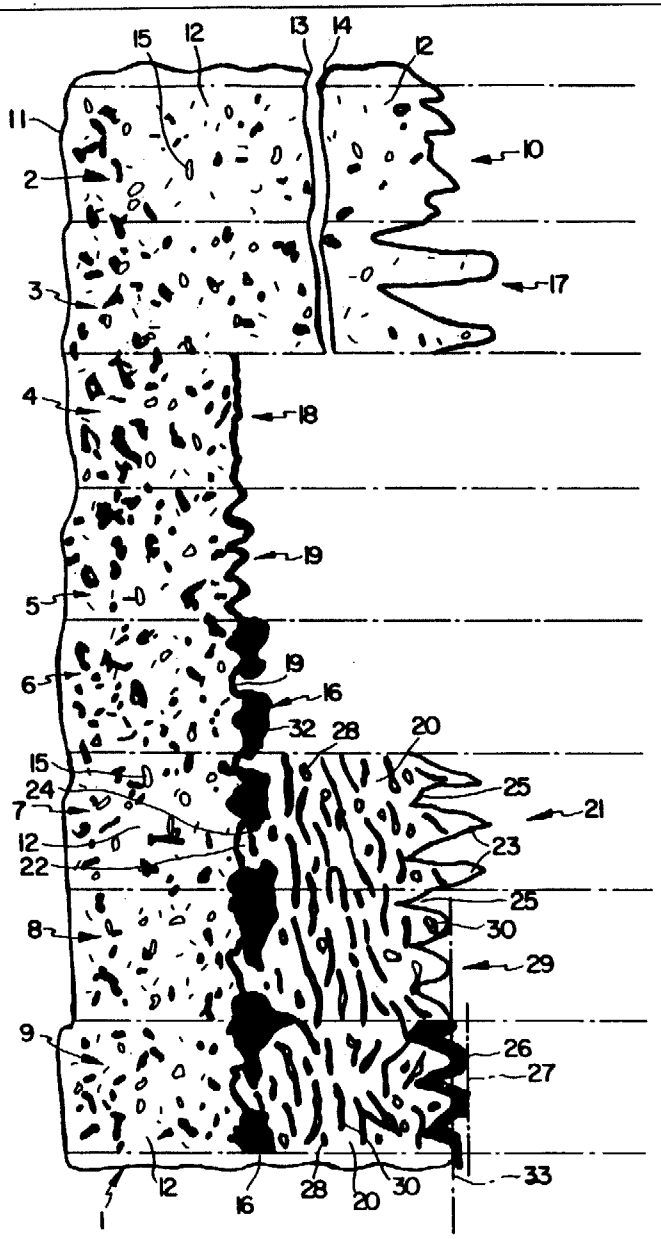

FIG. 1

UNITED STATES PATENT AND TRADEMARK OFFICE

CERTIFICATE OF CORRECTION

PATENT NO. : 4,862,609

DATED : September 5, 1989

INVENTOR(S) : Lothar Ullrich, et al.

It is certified that error appears in the above-identified patent and that said Letters Patent is hereby corrected as shown below:

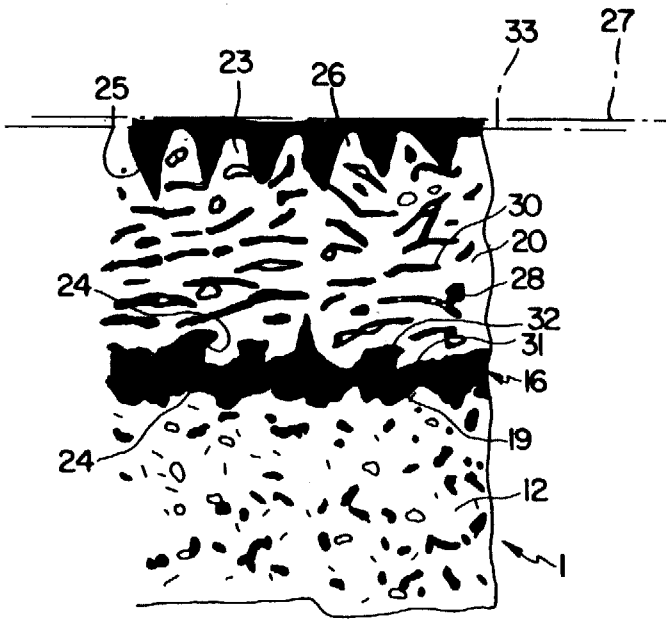

FIG. 2

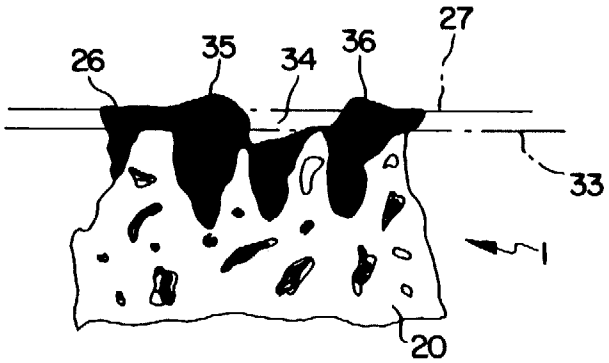

FIG. 3

Signed and Sealed this

Eighth Day of January, 1991

*Attest:*

*Attesting Officer*

HARRY F. MANBECK, JR.

*Commissioner of Patents and Trademarks*